US005474123A

United States Patent [19]

Buckshaw

[11] Patent Number: 5,474,123

[45] Date of Patent: Dec. 12, 1995

[54] TUBE SHIELD

[76] Inventor: Dennis J. Buckshaw, 42240 Crestview, Northville, Mich. 48167

[21] Appl. No.: 229,777

[22] Filed: Apr. 19, 1994

[51] Int. Cl.[6] ..... F28F 19/00

[52] U.S. Cl. ..... 165/134.1; 138/110

[58] Field of Search ..... 165/134.1; 122/DIG. 13; 138/110

[56] References Cited

U.S. PATENT DOCUMENTS

| | | | |
|---|---|---|---|
| 1,942,211 | 1/1934 | Hartwig | 165/134.1 |
| 2,646,818 | 7/1953 | Bimpson | 165/134.1 |
| 3,318,374 | 5/1967 | Block | 165/134 |
| 3,850,146 | 11/1974 | Graham et al. | 122/6 |
| 3,999,600 | 12/1976 | Bell | 165/78 |
| 4,619,314 | 10/1986 | Shimoda | 165/104.16 |
| 4,667,733 | 5/1987 | Bessouat et al. | 165/134.1 |
| 4,682,568 | 7/1987 | Green et al. | 122/DIG. 13 |
| 4,776,790 | 10/1988 | Woodruff | 432/233 |
| 4,809,645 | 3/1989 | Fournier et al. | 122/6 |
| 5,154,648 | 10/1992 | Buckshaw | 165/134.1 |
| 5,220,957 | 6/1993 | Hance | 165/134.1 |

OTHER PUBLICATIONS

Helmick Corporation Brochure, "Eliminate boiler and condenser tube failure with Helmick Tube Shields" (2 pp.).

*Primary Examiner*—Allen J. Flanigan

*Attorney, Agent, or Firm*—Young, MacFarlane & Wood

[57] ABSTRACT

A tube shield for protecting the tubes of heat exchangers, such as boilers and condensers, from hostile elements. The tube shield includes an axially elongated arcuate protector member and a plurality of spring clips secured to the axial free edges of the protector member at spaced locations along the length of the protector member. The spring clips are sized and configured such that they splay outwardly as the protector member is pressed downwardly over an associated tube to pass the maximum diameter of the tube and thereafter move inwardly in a spring biased manner to bitingly engage the exposed portion of the tube to preclude inadvertent separation of the protector from the tube. Each spring clip includes a central portion mounted to the protector member, an outboard portion extending circumferentially from the central portion to a location circumferentially beyond the respective free edge of the protector member, and an inboard portion extending circumferentially from the central portion to a location within the arc of the protector member. The clips are mounted to the protector member by mounting brackets which allow the clips to move both axially and circumferentially relative to the protector member.

25 Claims, 3 Drawing Sheets

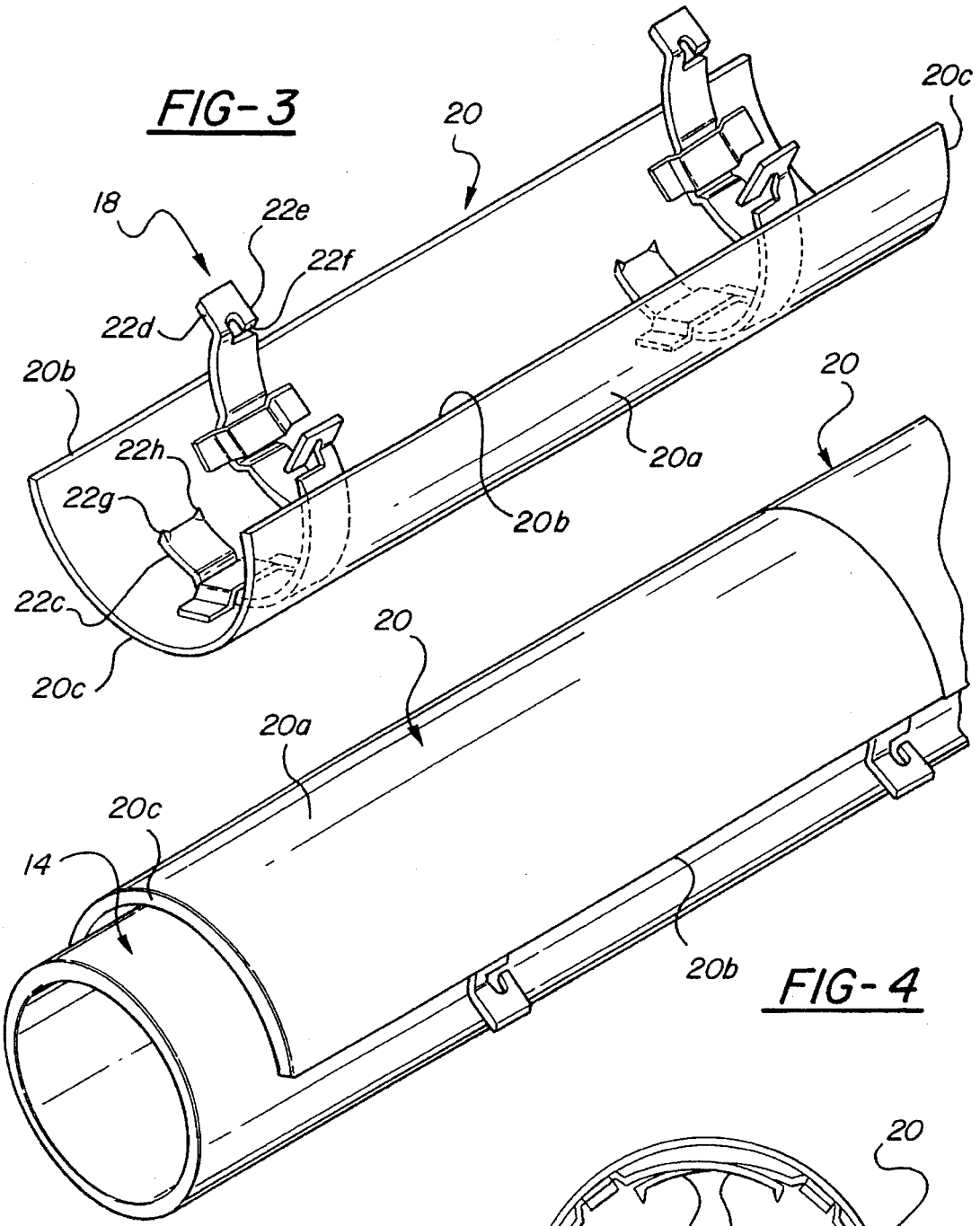
FIG-3
20
20c
18
22e
22f
22d
20b
22h
22g
22c
20c
20a
20b
20
20
20a
20c
14
20b
FIG-4
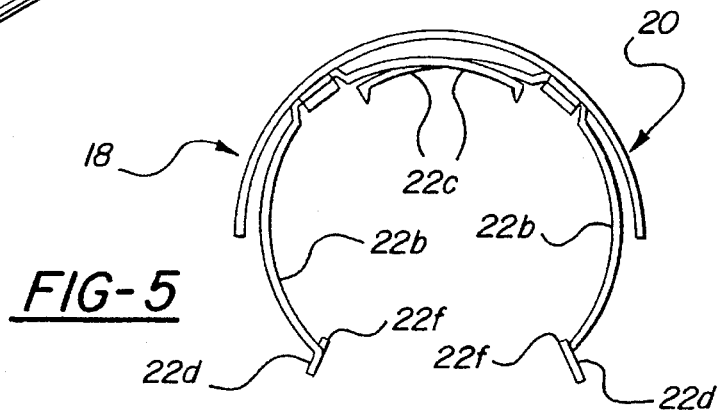
20
18
22c
22b
22b
22f
22f
22d
22d
FIG-5

TUBE SHIELD

FIELD OF THE INVENTION

This invention relates to tube shields and more particularly to shields for use in protecting the tubes of heat exchangers, such as boilers and condensers, from hostile elements.

BACKGROUND OF THE INVENTION

Tubes are in common use in various heat exchanger apparatuses such for example as boilers and condensers. The tubes employed in a boiler are commonly exposed to hostile elements such as fly ash. These hostile elements can have the effect of abrading and corroding the tubes with the result that the tubes experience early failure resulting in major maintenance and significant boiler downtime costs.

Many devices have been devised to protect the tubes from the hostile elements. In one such protective device, the shield includes an axially elongated protector member of arcuate cross section sized to fit over the tube to protect the portion of the tube embraced between the axial free edges of the member and straps are welded to the axial free edges of the member after the member has been fitted over the tube to maintain the protector in its protective position around the tube. Whereas this protective device has seen considerable usage, it suffers from the disadvantage that it requires shop labor to weld the straps between the axial free edges of the protector and, further, the welding in the vicinity of the tube may have the effect of altering the chemistry of the tube with resultant metal fatigue.

In another such protective device, also involving an axially elongated protector member of arcuate cross section, the axial free edges of the protector member are rolled radially outwardly and the inner surfaces of the rolled edges are spaced apart a distance less than the diameter of the tube to be protected so that the protector member may be snapped in place over the tube with the rolled axial free edges of the protector member engaging the tube to inhibit separation of the protector member from the tube. Whereas this device has also seen considerable usage, it suffers from the disadvantage that the radially outwardly rolled free edges of the protector member extend into the flow path between adjacent tubes so as to interfere with gas flow between adjacent tubes and, further, the rolled free edges, in order to have the required spring action to retain the protector member on the tube, must be relatively thick and this thickness of necessity must be carried through the entire protector member with the result that the protector member is heavier and more expensive than it need otherwise be to perform its protective function.

SUMMARY OF THE INVENTION

This invention is directed to the provision of an improved tube shield for use in connection with heat exchanger tubes.

More specifically, this invention is directed to the provision of a tube shield which is inexpensive, durable, and readily applied to the associated tube.

The tube shield of the invention is of the type including an axially elongated protector member of arcuate cross section sized to fit over the tube to protect the portion of the tube embraced between the axial free edges of the member and at least one spring clip secured proximate each free edge of the protector member sized and configured to bitingly engage a point on the exposed portion of the tube. According to the invention, each clip has a central portion mounted to the protector member, an outboard portion extending circumferentially from the central portion to a location circumferentially beyond the respective free axial edge of the protector member, and an inboard portion extending circumferentially from the central portion to a location within the arc of the protector member. This arrangement provides a simple, inexpensive, and extremely effective means of retaining the protector member on the tube.

According to a further feature of the invention, each clip is mounted to the protector member by means permitting axial movement of the clip relative to the protector member. This arrangement allows the clip to grow axially with the associated tube so as to accommodate unequal rates of thermal expansion as between the tube and the protector member.

According to a further feature of the invention, each clip is mounted to the protector member by means permitting circumferential movement of the clip relative to the protective member. This arrangement allows the clip to grow circumferentially with the associated tube to accommodate unequal rates of thermal expansion as between the protector member and the tube.

According to a further feature of the invention, the central portion of each clip is mounted to the protector member by a mounting bracket defining an opening receiving the central portion of the clip and having an axial extent greater than the width of the central portion of the clip and a height greater than the thickness of the central portion of the clip. This arrangement provides a simple and efficient means of attaching the clip to the protector member while allowing both axial and circumferential movement of the clip relative to the protector member.

According to a further feature of the invention, the inboard and outboard portions of each clip are joined to the central portion by shoulders which coact with the bracket to delimit the permitted extent of circumferential movement of the clip relative to the protector member.

According to a further feature of the invention, a radially inwardly extending prong portion is provided proximate the free end of the outboard portion of each clip and proximate the free end of the inboard portion of each clip. This arrangement allows both the inboard and outboard portions of the clip to bitingly engage the associated tube so as to maximize the gripping action of the clip on the tube.

BRIEF DESCRIPTION OF THE DRAWINGS

FIG. 3 is a perspective view of a tube shield according to the invention;

FIG. 4 is a perspective view of invention tube shields shown embracing a tube;

FIG. 5 is an end view of a tube shield according to the invention;

DETAILED DESCRIPTION OF THE PREFERRED EMBODIMENT

Figure 1:
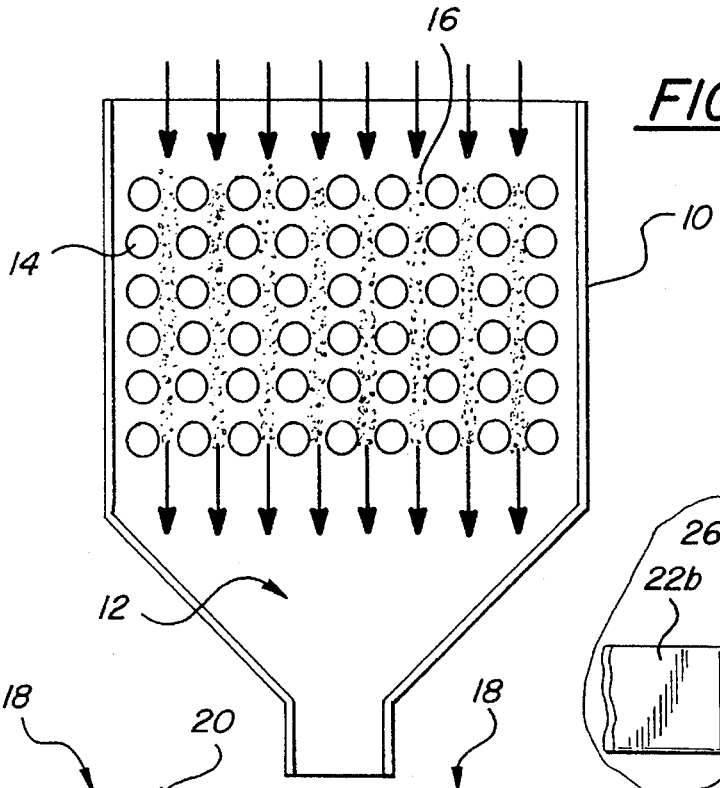
FIG. 1 is a view of a portion of a boiler employing vertical rows of tubes to perform a heat exchanger function within the boiler.

The apparatus illustrated in FIG. 1 may form a portion of a boiler or condenser and includes a housing 10 defining a chamber 12 within which vertical rows of tubes 14 are suitably positioned. The tubes are exposed to hostile elements as they perform their heat exchanger function such for example as fly ash 16 moving downwardly between the vertical rows of tubes. It will be understood that the fly ash results from the combustion of coal in an earlier stage of the overall boiler function. The tubes, if left exposed to the fly ash over an extended period of time, would gradually abrade and corrode. It is necessary therefore to protect the tubes from the hostile elements such as the fly ash 16.

The tubes are shielded from the fly ash 16 by the use of tube shields 18 constructed and utilized in accordance with the invention.

Each tube shield 18 includes a protector member 20, a plurality of spring clips 22, and a plurality of mounting brackets 24.

Each protector member 20 is axially elongated and has an arcuate cross section so as to define an arcuate main body portion 20*a*, axially extending free edges 20*b*, and arcuate end edges 20*c*. Main body portion 20*a* is formed on a radius generally corresponding to the radius of the tube 14 to be shielded and extends through an included angle of approximately 180° so that the protector member, when placed over the associated tube, embraces and protects approximately 180° of the tube and leaves exposed approximately 180° of the tube.

The protector member 20 may be formed, depending on the particular application, of a variety of ferrous materials ranging anywhere from a 304 series Stainless Steel to a very high nickel content stainless steel available under the trade name INCONEL. Protective member 20 may have a thickness for example of between 1/16 and 1/8 inch and a length of two feet. It will be understood that a plurality of protector members 20 would be placed end to end over an associated tube 14 to protect a tube having a length in excess of two feet.

Each spring clip 22 has a generally arcuate configuration and includes a central portion 22*a*, an outboard portion 22*b*, and an inboard portion 22*c*. The free end 22*d* of the outboard portion 22*b* is bent outwardly relative to outboard portion 22*b* and a prong portion 22*e* is struck from the free end of the outboard portion so as to project inwardly from the outboard portion and terminate in a free biting edge 22*f*. The free end 22*g* of the inboard portion 22*c* has an arcuate configuration and defines a pair of prong portions 22*h* proximate the opposite side edges of the inboard portion and extending generally radially inwardly relative to the inboard portion for biting engagement with an associated tube. Outboard portion 22*b* is joined to central portion 22*a* by a shoulder 22*i* and inboard portion 22*c* is joined to central portion 22*a* by a shoulder 22*j*.

Each clip preferably has a thickness of between 1/16 and 1/8 inch and typically has a thickness approximating the thickness of the associated protector member 20.

Each mounting bracket 24 includes a central portion 24*a* and end portions 24*b* joined to central portion 24*a* by shoulders 24*c*. Each mounting bracket preferably has a thickness of between 1/16 and 1/8 inch and preferably has a thickness approximately the thickness of the associated spring clip.

Clips 22 and mounting brackets 24 may be formed for example of strips of suitable ferrous material ranging from a relatively inexpensive 304 series stainless steel to a high nickel content stainless steel such as INCONEL.

Each spring clip is mounted within the protector member by positioning the spring clip in its desired position within the protector member, placing the associated bracket 24 over the protector member with the central portion 24*a* of the bracket overlying the central portion 22*a* of the spring clip, and welding the mounting bracket end portions 24*b* to the protective member.

Figure 11:
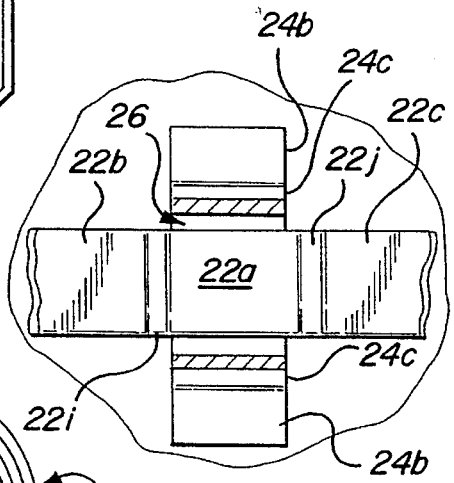
FIG. 11 is a fragmentary plan view of an invention spring clip in association with an invention mounting bracket.
Figure 10:
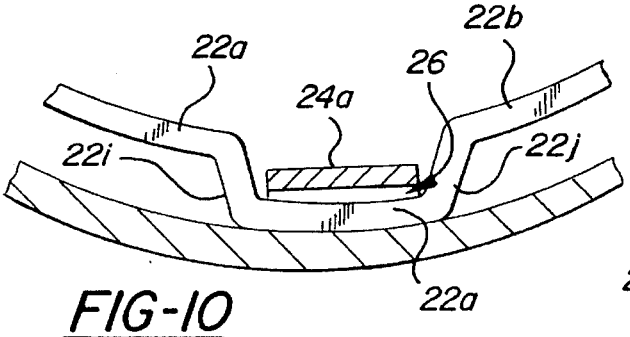
FIG. 10 is a cross-sectional view taken on line 10—10 of FIG. 9.
Figure 8:
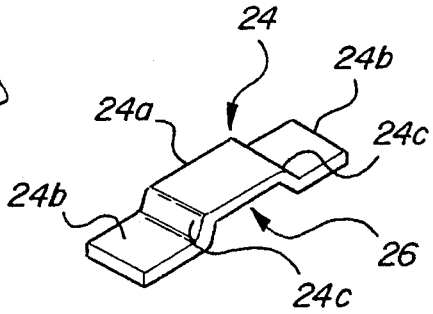
FIG. 8 is a perspective view of a mounting bracket employed in the invention tube shield.
Figure 9:
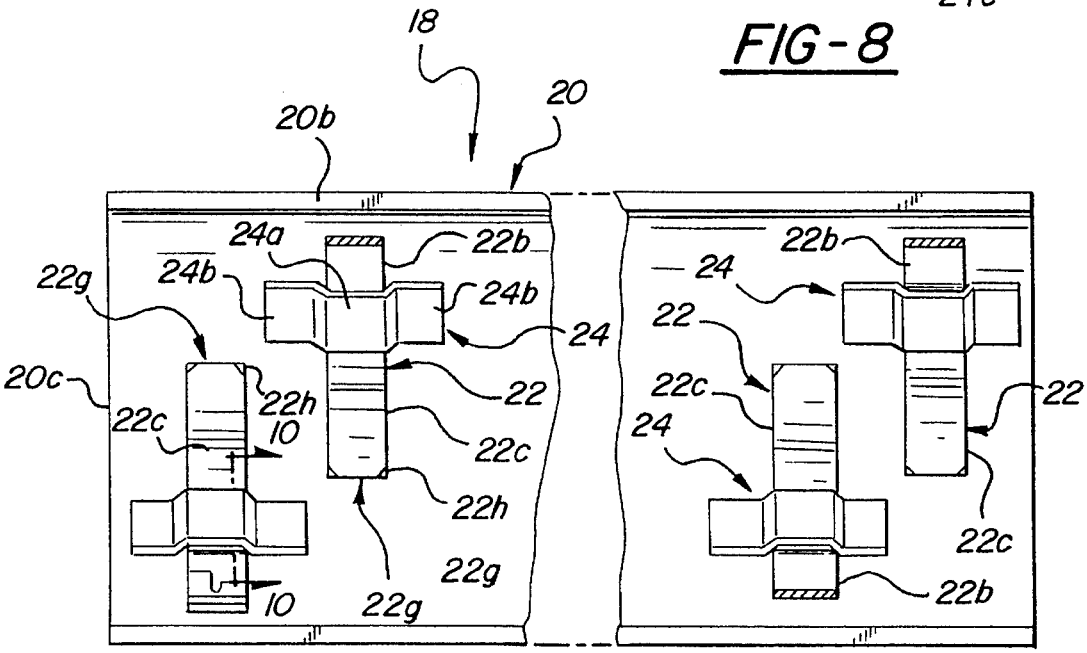
FIG. 9 is a plan view of the invention tube shield.

The central portion 22*a* of each clip thus passes through the opening 26 defined between the central portion 24*a* of the mounting bracket and the confronting surface of the protector member. As best seen in FIGS. 10 and 11, the opening 26 defined between the mounting bracket and the protector member has an axial extent greater than the width of the central portion 22*a* of the spring clip so that the spring clip may move axially relatively to protector member and has a height greater than the thickness of the central portion 22*a* of the protector member so that the spring clip may move circumferentially relatively to the protector member.

The extent of circumferential movement of the clip relative to the protector member is defined and delimited by the clip shoulders 22*i* and 22*j* which are spaced circumferentially apart by a distance greater than the width of the central portion 24*a* of the mounting bracket shoulders 22*i* and 22*j* and abuttingly engage the respective side edges of the central portion 24*a* of the mounting bracket in response to circumferential movement of the spring clip relative to the protector member to limit the circumferential movement of the spring clip in either circumferential direction.

The extent of axial movement of the clip relative to the protector member is defined and delimited by the bracket shoulders 24*c* which are spaced axially apart by a distance greater than the width of the central portion 22*a* of the clip and abuttingly engage the respective side edges of the central portion of the clip in response to axial movement of the clip relative to the protector member to limit the axial movement of the clip in either axial direction.

The spring clips, as best seen in FIG. 3, are preferably arranged in pairs with a pair of clips proximate each end of the protector member and each pair including a clip associated with one protector member axial edge 20*b* and another clip associated with the opposite protector member axial edge 20*b*. It will be understood that the brackets and clips could also be disposed on the outer surface of the protector member rather than on the inner surface as shown.

Figure 6:
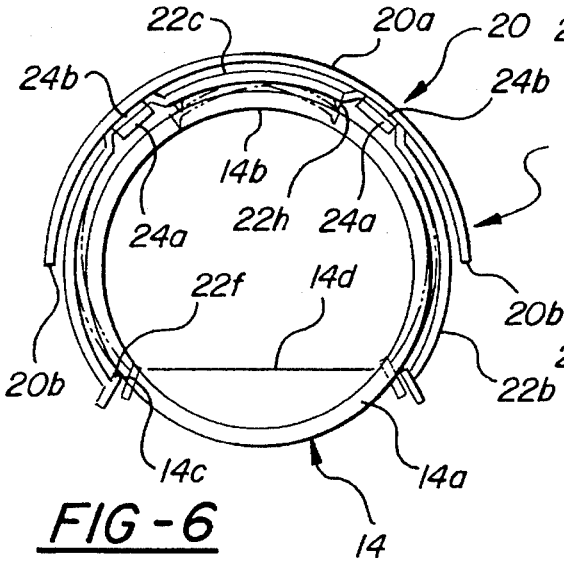
FIG. 6 is an end view of an invention tube shield shown embracing a tube.
Figure 7:
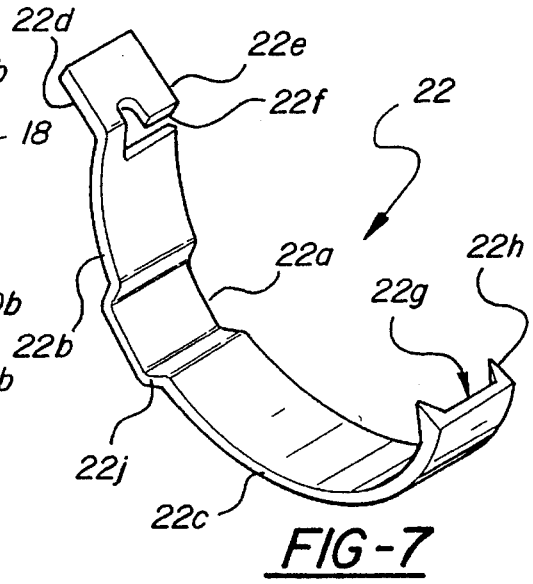
FIG. 7 is a perspective view of a spring clip employed in the invention tube shield.

The mounting of the protector member on the associated tube is best seen in FIGS. 4 and 6. The relaxed configuration of the inboard and outboard portions of the clips is shown in dotted lines in FIG. 6, and the configuration assumed by the inboard and outboard portions of the clips following the mounting of the protector member on the tube is seen in solid lines.

Specifically, as the protector member is applied to the associated tube 14 by pressing the protective member over the tube, the prong portions 22*e* on the outboard ends of the outboard portions of the spring clips splay outwardly in cantilever fashion to pass over the maximum diameter of the tube and then move resiliently inwardly, as the protector member moves into an embracing position with respect to the tube, into biting engagement with points on the exposed portion 14*a* of the tube with the biting engagement occurring specifically as biting engagement of the biting edges 22*f* of the prongs 22*e* with the outer surface of the tube.

Similarly, as the protector member is moved downwardly over the tube to its embracing position, the inboard portions 22*c* of the clips move outwardly in cantilever fashion from their dotted line to their solid line positions so that the prongs 22*h* on the free ends of the inboard portions of the clips bite into the confronting surfaces of the embraced portion 14*b* of the tube.

It will specifically be seen that the biting edges 22*f* on the prong portions 22*e* of the tube clips of each pair are sized to bitingly engage points 14*c* on the exposed surface of the tube lying on a chord 14*d* of the tube and that the clips have a relaxed configuration in which the biting edges 22*f* of the clips are spaced apart by a distance less than the length of the chord, whereby to ensure their biting engagement with the surface of the tube in the embraced position of the protector member.

It will further be seen that each pair of clips, in the embraced position of the protector member over the tube, bitingly engages the tube at four circumferentially spaced points with the prong portions of the spring clips in every case being spring biased into biting engagement with the tube so that each pair of spring clips acts to positively and effectively preclude movement of the mounting member relative to the tube once the protector member has been installed over the tube.

Further, by virtue of the permitted circumferential and axial movement of the clips relative to the protector member, the clips may move or grow both circumferentially and axially with the tube without losing their biting engagement with the tube even in situations where the coefficient of expansion of the tube relative to the coefficient of the expansion of the protector member is such that the tube and the protector member grow unequally.

Figure 2:
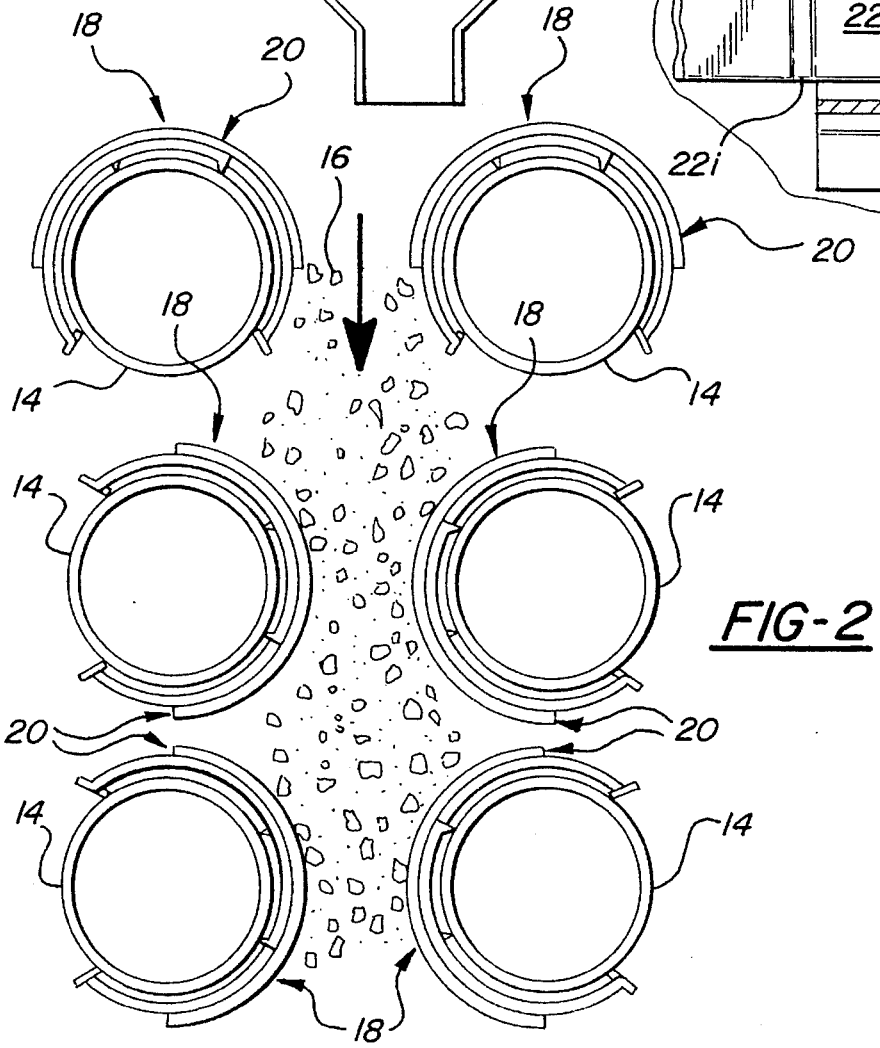
FIG. 2 is a view showing the invention tube shield installed in association with adjacent vertical rows of tubes.

As will be apparent, the invention tube shield is selectively applied to the portions of tubes 14 where protection is required or desired. For example, in the tube arrangement seen in FIG. 2, including two vertical rows of tubes 14, shields 18 may be snappingly applied over the upper portions of the tubes 14 in the upper row while shields 18 may be applied to the confronting inboard side portions of the tubes 14 in lower rows since the fly ash 16 will impact primarily on the upper portion of the tubes 14 in the upper row and will impact primarily on the side portions of the tubes 14 in the lower rows as the fly ash moves downwardly between the vertical rows. Other tube arrangements will of course require different applications of the tube shields 18 to provide the required or desired protection for the tubes.

The invention tube shield will be seen to provide many important advantages as compared to prior art shields. Specifically, the invention shields are extremely simple in construction and extremely inexpensive; the invention shields may be readily applied to selected portions of selected tubes to provide the required and desired protection; the tube shields, once applied, are positively retained in their embracing position with respect to the tubes; the attaching means for the tube shields, in the mounted position of the tube shields on the tubes, do not interfere with gas flow between adjacent rows of tubes; since the clips are formed independently of the protector member the clip thickness may be chosen to maximize the spring strength of the clips while, if desired, allowing thinner stock to be utilized for the protector members so as to minimize weight and cost; the manufacturing requirements to assemble the tube shields to the tubes may be performed in a manufacturing environment rather than requiring on site labor with resultant costs and potential damage to the associated tubes; and the clips are free to move both axially and circumferentially relative to the tube so that the clips may retain their biting engagement with the tube irrespective of inequalities in the thermal expansion of the protector members relative to the tubes.

Whereas a preferred embodiment of the invention has been illustrated and described in detail, it will be apparent that various changes may be made in the disclosed embodiment without departing from the scope or spirit of the invention.

I claim:

1. A tube shield of the type including an axially elongated protector member of arcuate cross section sized to fit over the tube to protect the portion of the tube embraced between the axial free edges of the protector member and at least one spring clip secured proximate each axial free edge of the protector member, characterized in that each clip has a central portion mounted to the protector member, an outboard portion extending circumferentially from the central portion to a location circumferentially beyond the respective free edge of the protector member, and an inboard portion extending circumferentially from the central portion to a location within the arc of the protector member.

2. A shield according to claim 1 wherein the central portion of each clip is mounted to the protector member by means permitting axial movement of the clip relative to the protector member.

3. A shield according to claim 1 wherein the central portion of each clip is mounted to the protector member by means permitting circumferential movement of the clip relative to the protector member.

4. A clip shield according to claim 1 wherein the central portion of each clip is mounted to the protector member by means permitting axial and circumferential movement of the clip relative to the protector member.

5. A shield according to claim 1 wherein the clips are arranged in pairs with a clip proximate one axial edge paired with a clip proximate the other axial edge.

6. A shield according to claim 4 wherein the central portion of each clip is mounted to the protector member by a mounting bracket defining an opening receiving the central portion of the clip and having an axial extent greater than the width of the central portion of the clip and a height greater than the thickness of the central portion of the clip.

7. A shield according to claim 6 wherein the inboard and outboard portions of each clip are joined to the central portion by shoulders which coact with the mounting bracket to delimit the permitted extent of circumferential movement of the clip relative to the protector member.

8. A shield according to claim 1 wherein a radially inwardly extending prong portion is provided proximate the free end of the outboard portion of each clip and proximate the free end of the inboard portion of each clip.

9. A tube shield of the type including an axially elongated protector member of arcuate cross section sized to fit over the tube to protect the portion of the tube embraced between the axial free edges of the protector member and at least one spring clip mounted proximate each free axial edge of the protector member, characterized in that each clip is mounted to the protector member by mounting means permitting axial movement of the clip relative to the protector member.

10. A tube shield according to claim 9 wherein the mounting means for each clip also permits circumferential movement of the clip relative to the protector member.

11. A tube shield according to claim 10 wherein the mounting means includes a mounting bracket secured to the protector member and defining an opening through which the respective clip passes having a height greater than the thickness of the clip and an axial extent greater than the width of the clip.

12. A tube shield according to claim 11 wherein each clip is configured to define shoulders on confronting opposite sides of the mounting bracket which coact with the mounting bracket to delimit the permitted circumferential movement of the clip relative to the protector member.

13. A tube shield of the type including an axially elongated protector member of arcuate cross section sized to fit over the tube to protect the portion of the tube embraced between the free axial edges of the protector member and at least one spring clip mounted proximate each free axial edge of the protector member, characterized in that each clip is mounted to the protector member by mounting means permitting circumferential movement of the clip relative to the protector member.

14. A tube shield according to claim 13 wherein the mounting means for each clip includes a mounting bracket secured to the protector member and defining an opening receiving the respective clip and having a height greater than the thickness of the clip.

15. A tube shield according to claim 14 wherein each clip is configured to define shoulders on circumferentially opposite sides of the respective mounting bracket to delimit the permitted circumferential movement of the clip relative to the protector member.

16. A tube shield according to claim 14 wherein each clip includes a central mounting portion received in the opening of the respective mounting bracket, an outboard portion extending circumferentially from the central portion to a location circumferentially beyond the respective free axial edge of the protector member, and an inboard portion extending circumferentially from the central portion to a location within the arc of the protector member.

17. A tube shield according to claim 16 wherein a radially inwardly extending prong portion is provided proximate the free end of the outboard portion of each clip and proximate the free end of the inboard portion of each clip.

18. A tube shield according to claim 14 wherein the opening of each mounting bracket has an axial extent greater than the width of the respective clip so as to permit axial movement of the clip relative to the protector member.

19. A tube shield comprising:

an axially elongated protector member of arcuate cross section sized to fit over the tube to protect the portion of the tube embraced between the free axial edges of the member;

a spring clip secured to the protector member proximate each axial free edge of the protector member and each including a central portion, an arcuate inboard portion and an arcuate outboard portion;

a mounting bracket for each clip secured to the protector member and defining an opening receiving the central portion of the respective clip with the inboard portion of the clip extending circumferentially and arcuately from the central portion to a location within the arc of the protector member and the outboard portion of the clip extending circumferentially and arcuately from the central portion to a location circumferentially beyond the respective free axial edge of the protector member.

20. A tube shield according to claim 19 wherein the opening defined by each mounting bracket has a height greater than the thickness of the central portion of the respective clip and an axial extent greater than the width of the central portion of the respective clip so as to permit circumferential and axial movement of the clip relative to the protector member.

21. A tube shield according to claim 20 wherein the inboard and outboard portions of each clip are joined to the central portion of the clip by shoulders which coact with the respective mounting bracket to delimit the permitted extent of circumferential movement of the clip relative to the protector member.

22. A tube shield according to claim 19 wherein a radially inwardly extending prong portion is provided proximate the free end of the outboard portion of each clip and proximate the free end of the inboard portion of each clip.

23. A tube shield including an axially elongated protector member of arcuate cross section sized to fit over the tube to protect the portion of the tube embraced between the axial free edges of the protector member and at least one spring clip secured proximate each axial free edge of the protector member, each clip having a free resilient flexible end, the clips being sized to bitingly engage points on the exposed surface of the tube lying on a chord of the tube, and the clip having a relaxed configuration in which the free end of a clip proximate one axial edge of the protector member is spaced from the free end of a clip proximate the other axial edge of a protector member by a distance less than the length of the chord, characterized in that each clip has another free end positioned within the arc of the protector member and bitingly engaging a point on the embraced portion of the tube with the protector member fitted over the tube.

24. A tube shield according to claim 23 wherein each clip includes a central portion secured to the protector member, an outboard portion extending from the central portion to a location circumferentially beyond the respective free edge of the tube and defining the free end engaging the exposed portion of the tube, and an inboard portion extending from the central portion to a location within the arc of the protector member and defining the free end engaging the embraced portion of the tube.

25. A tube shield according to claim 24 wherein the central portion of the clip is mounted on the protector member by a mounting bracket secured to the protector member and defining an opening receiving the central portion of the clip and having an axial extent greater than the width of the central portion of the clip and a height greater than the thickness of the central portion of the clip.

* * * * *